US008581794B1

(12) United States Patent
Shor et al.

(10) Patent No.: US 8,581,794 B1
(45) Date of Patent: Nov. 12, 2013

(54) CIRCULAR ANTENNA ARRAY SYSTEMS

(75) Inventors: Arie Shor, Sunnyvale, CA (US); Mark Rich, Menlo Park, CA (US)

(73) Assignee: QUALCOMM Incorporated, San Diego, CA (US)

( * ) Notice: Subject to any disclaimer, the term of this patent is extended or adjusted under 35 U.S.C. 154(b) by 552 days.

(21) Appl. No.: 12/717,658

(22) Filed: Mar. 4, 2010

(51) Int. Cl.
*H01Q 13/00* (2006.01)

(52) U.S. Cl.
USPC ..... 343/776; 343/777; 343/772; 343/786

(58) Field of Classification Search
USPC ..... 343/776, 893, 777, 772, 786
See application file for complete search history.

(56) References Cited

U.S. PATENT DOCUMENTS

| | | | | |
|---|---|---|---|---|
| 2,316,151 | A * | 4/1943 | Barrow | 343/786 |
| 2,520,008 | A * | 8/1950 | King | 342/6 |
| 3,465,342 | A * | 9/1969 | Delapalme | 342/444 |
| 5,363,105 | A * | 11/1994 | Ono et al. | 342/20 |
| 6,307,524 | B1 | 10/2001 | Britain | |
| 6,326,922 | B1 | 12/2001 | Hegendoerfer | |
| 7,193,562 | B2 | 3/2007 | Shtrom et al. | |
| 7,307,579 | B2 * | 12/2007 | Rees et al. | 342/29 |
| 7,358,912 | B1 | 4/2008 | Kish et al. | |
| 7,362,280 | B2 | 4/2008 | Shtrom et al. | |
| 7,498,996 | B2 | 3/2009 | Shtrom et al. | |
| 7,498,999 | B2 | 3/2009 | Shtrom | |
| 7,511,680 | B2 | 3/2009 | Shtrom et al. | |
| 7,525,486 | B2 | 4/2009 | Shtrom et al. | |
| 7,551,680 | B2 | 6/2009 | Goldberg | |
| 2004/0085249 | A1 * | 5/2004 | Kitamori et al. | 343/776 |
| 2006/0234657 | A1 * | 10/2006 | Boyle | 455/129 |
| 2009/0303147 | A1 * | 12/2009 | Choudhury | 343/776 |

* cited by examiner

*Primary Examiner* — Dieu H Duong
(74) *Attorney, Agent, or Firm* — Bever, Hoffman & Harms, LLP

(57) ABSTRACT

Antenna arrays providing high gain during wireless communications are highly desirable for many applications including, but not limited to, multiple-in multiple-out (MIMO) streams and video transmissions. Optimized antenna arrays should also ensure ease of manufacture, thereby enhancing commercial viability. Circular antenna arrays including horn antennas or Yagi antennas are described, each circular antenna array ensuring ease of manufacture.

18 Claims, 11 Drawing Sheets

CIRCULAR ANTENNA ARRAY SYSTEMS

BACKGROUND OF THE INVENTION

1. Field of the Invention

The present invention relates to antenna systems and in particular to configurations of circular antenna arrays.

2. Related Art

Antenna arrays providing high gain during wireless communications are highly desirable for many applications including, but not limited to, multiple-in multiple-out (MIMO) streams and video transmissions. Optimized high gain antenna arrays should also ensure ease of manufacture, thereby enhancing commercial viability.

SUMMARY OF THE INVENTION

A circular antenna array is described. This circular array includes a substrate, a plurality of horn antennas, and a plurality of feed elements. The plurality of horn antennas are secured to the substrate and are positioned radially from a predetermined area on the substrate. Notably, in one embodiment, this predetermined area is free of components. In another embodiment, this predetermined area includes only switching elements associated with the plurality of horn antennas. Each feeder element is positioned inside an associated horn antenna and secured to the substrate.

In one embodiment, the substrate can be a printed circuit board (PCB). In another embodiment, each horn antenna array can be formed from sheet metal. In yet another embodiment, each feed element can include an inverted-F component with support legs. In yet another embodiment, the antenna array can further include a plurality of switching elements, wherein each switch position of each switching element connects to a set of the plurality of horn antennas.

A circular antenna array including Yagi antennas is also described. This circular antenna array includes a switch board and a plurality of printed Yagi antennas. The switch board has a plurality of slots disposed on edges of the switch board. The Yagi antennas are configured to mate with the plurality of slots. In one embodiment, a set of the plurality of Yagi antennas can be vertically-oriented when mated with the switch board. In another embodiment, a second plurality of Yagi antennas can be integrally formed with the switch board. In yet another embodiment, a set of the plurality of Yagi antennas can be horizontally-oriented when mated with the switch board. The circular Yagi antenna array can also include a plurality of shunt PiN diode switches disposed on the switch board and connected to the plurality of Yagi antennas.

An antenna for a wireless communication device is also described. This antenna can include three legs. The first and second legs can form a first "V" shape in a first layer of a substrate. The third leg can be formed in a second layer of the substrate. A via can connect the second leg and the third leg, wherein the second leg and the third leg form a second "V" shape. In one embodiment, the antenna can further include an inductor connected to an RF feed point of the first leg, wherein the RF feed point and the inductor can be formed in a ground plane.

DETAILED DESCRIPTION OF THE FIGURES

Figure 1:
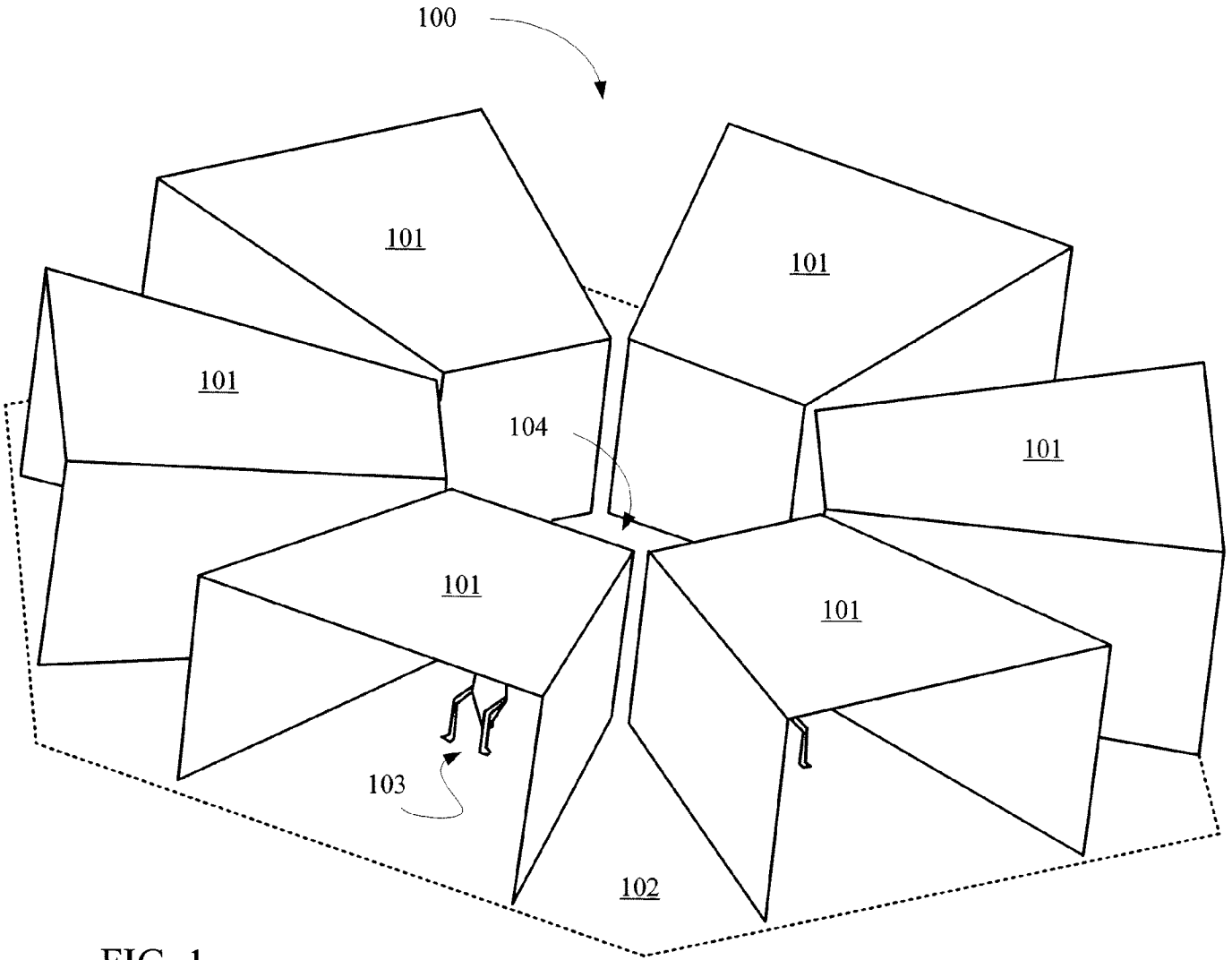
FIG. 1 illustrates a perspective view of an exemplary circular antenna array including a plurality of horns.

FIG. 1 illustrates an exemplary circular array 100 including a plurality of horn antennas 101 mounted on a substrate 102 in a radial formation around a predetermined area 104. Although six horns 101 are shown, other embodiments may include more or less horns. Also mounted on substrate 102 are a plurality of feed elements 103, wherein each horn antenna 101 has an associated feed element 103 positioned inside. Notably, predetermined area 104 of substrate 102 as delineated by the ends of horns 101 is component-free or, alternatively, limited to switching elements described in detail below.

Figure 2:
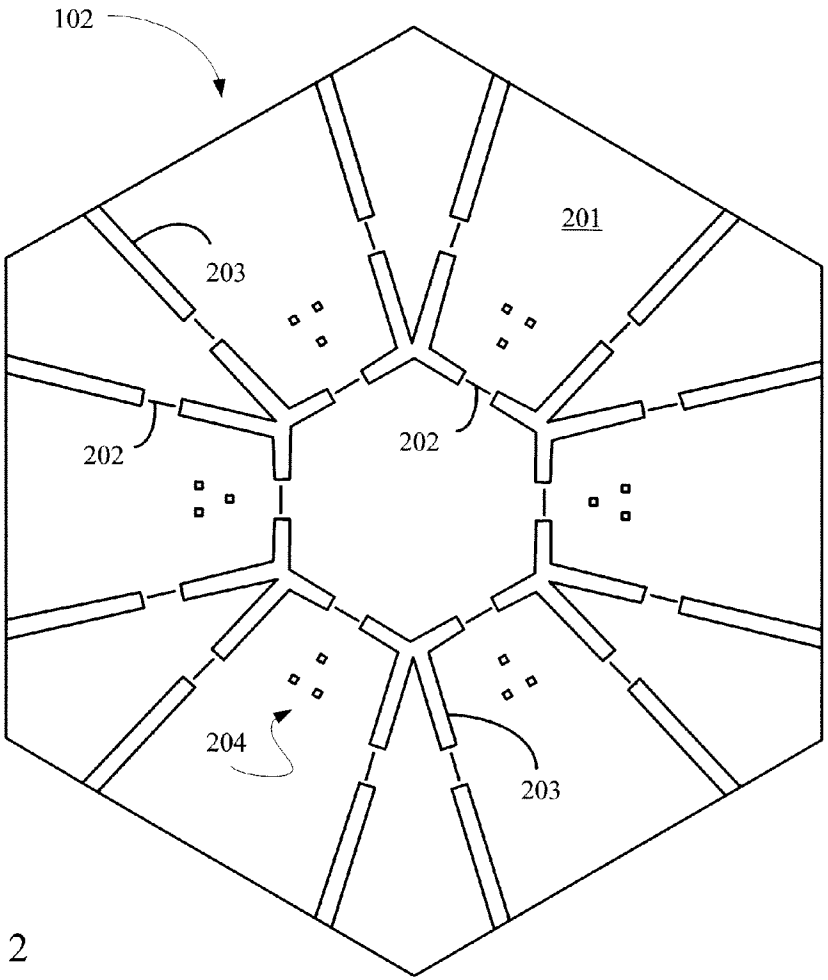
FIG. 2 illustrates an exemplary substrate for the circular antenna array shown in FIG. 1.

FIG. 2 illustrates an exemplary substrate 102, which can be formed using a printed circuit board (PCB) 201 including slots 202 and metal traces 203. Slots 202 can be used for quick alignment of horn antennas 101 onto PCB 210 during manufacture. Metal traces 202 can be used to secure horn antennas 101 (FIG. 1) to PCB 201 by, for example, soldering. Metal pads 204 can be used to secure feed elements 103 onto PCB 210 during manufacture. As is well-known to those skilled in the art, the metal traces 202 and 203 may be realized with printed circuits or any other technically feasible means that will allow the mounting and electrical coupling of the horn antennas 101 to the PCB 210.

Figure 4:
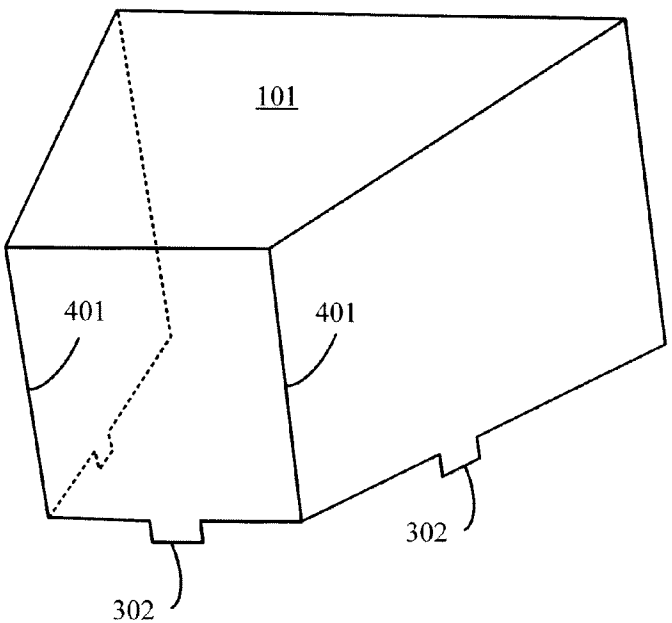
FIG. 4 illustrates the horn template when assembled and ready for mounting on the substrate.
Figure 3:
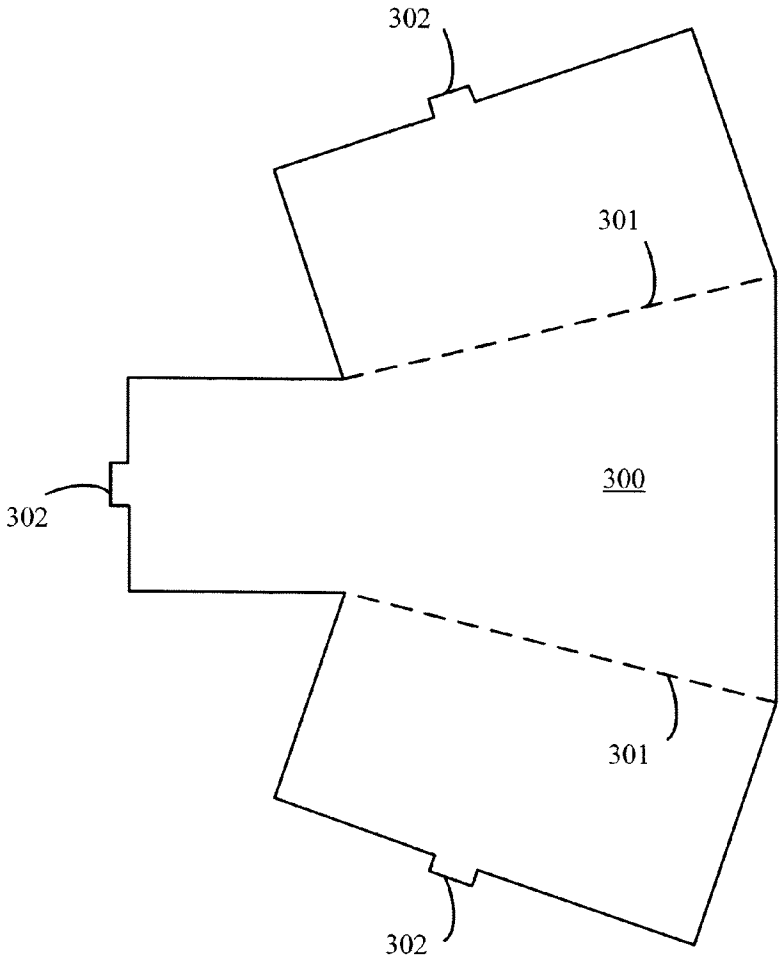
FIG. 3 illustrates an exemplary horn template for the circular antenna array shown in FIG. 1.

FIG. 3 illustrates a plane view of a template 300 for the horn antenna. In one embodiment, the horn antennas can be fabricated from a standard sheet metal. After fabrication, horn antenna 300 can be bent at lines 301, thereby forming the three sides of the horn. FIG. 4 illustrates horn antenna 101 after assembly using template 300.

After assembly, horn antenna 101 can be mounted onto substrate 102 (FIG. 1). Note that tabs 302 can be fit into slots 202 of substrate 102, thereby providing a quick, accurate alignment of horn antenna 101 to substrate 102. In other embodiments where slots 202 and tabs 302 are not provided, the bottom edges of horn antenna 101, when assembled, can be aligned with metal traces 203 and then soldered into place. In one embodiment, referring to FIG. 4, back edges 401 of horn antenna 101 can also be soldered together to optimize transmission. Once horn antenna 101 is secured to substrate 102 (see FIG. 1), substrate 102 forms a fourth pseudo-side to horn antenna 101. As shown in FIG. 1, secured horn antennas 101 are asymmetric in the vertical plane. However, horn antennas 101 can advantageously keep the beam peak in the azimuth plane.

Figure 5B:
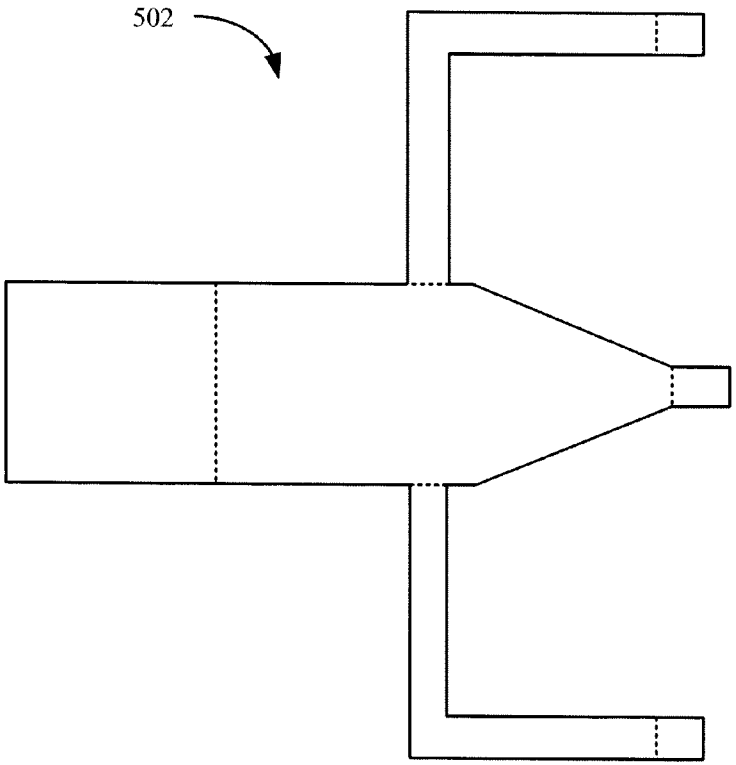
FIG. 5B illustrates a template for the feeder element shown in FIG. 5A.
Figure 5A:
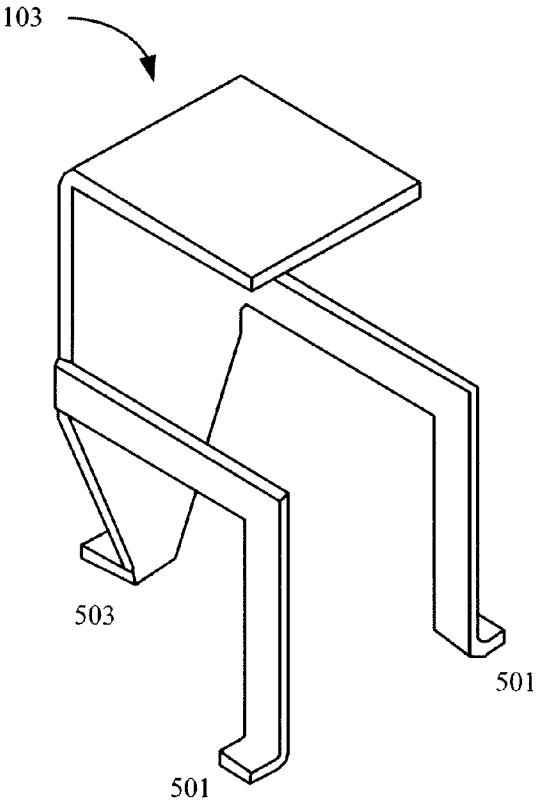
FIG. 5A illustrates an exemplary feeder element for the circular antenna array.

FIG. 5A illustrates an exemplary feed element 103. In one embodiment, feed element 103 can have an inverted-F design and include two support legs 501 that can be grounded (e.g. soldered) to substrate 102 using pads 204. FIG. 5B illustrates an exemplary template 502 for the feed element. In one embodiment, the feed element can be fabricated from a sheet metal and folded at the dotted lines to form feed element 103 shown in FIG. 5A. Note that a feedpoint 503 (FIG. 5A) forms a third point of contact with substrate 102.

Figure 6:
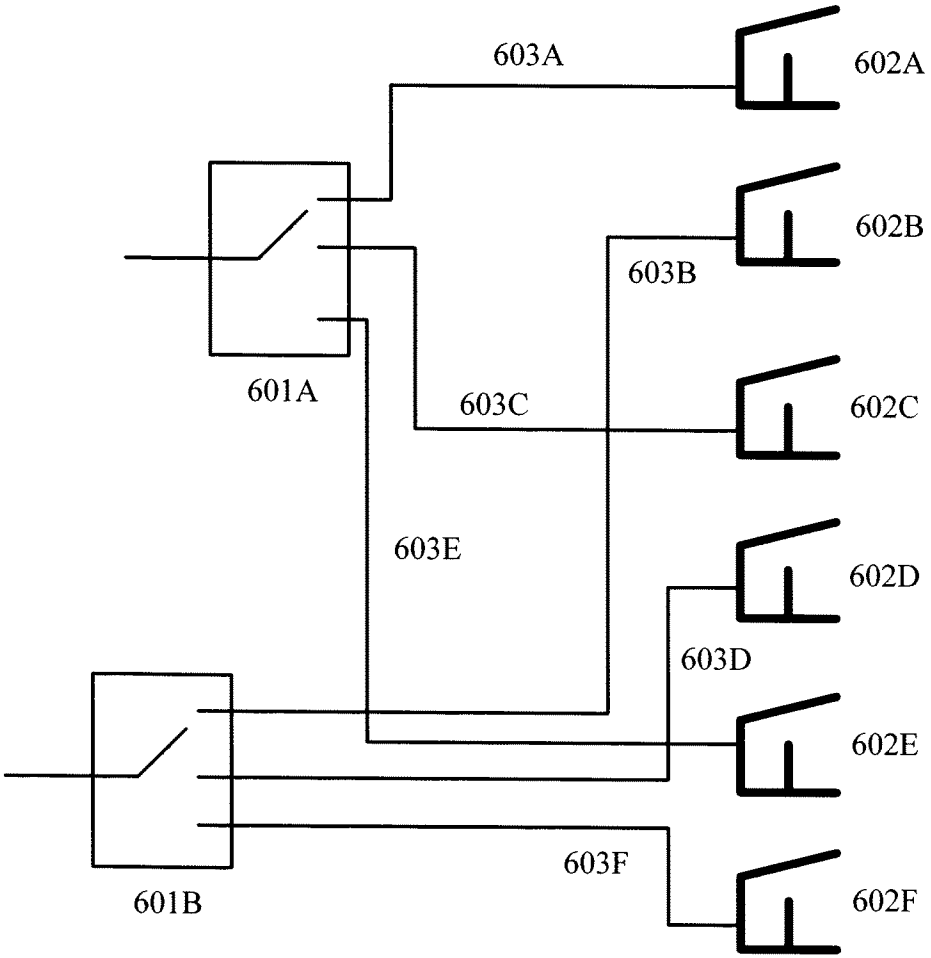
FIG. 6 illustrates an exemplary switching array for the circular antenna array shown in FIG. 1.

FIG. 6 illustrates an exemplary switching configuration including a plurality of horn antenna sets 602A-602F (each horn antenna set 602 showing a side view of an assembled horn antenna, its associated feeder element, and a portion of the substrate), two switches 601A and 602B, and a plurality of lines 603A-603F connecting antenna sets 602A-602F to switches 601A or 601B. In FIG. 6, adjacent horn antenna sets indicate adjacency on the substrate with the understanding that in a circular horn antenna array, horn antenna sets 602A and 602F are also adjacent.

In one embodiment, to support MIMO streams, two streams can be switched between adjacent horn antenna sets. For example, switches 601A and 601B when switched to a first (top) position connect to lines 603A and 603B, respectively. In this configuration, horn antenna sets 602A and 602B, which are connected to lines 603A and 603B, are used. Switches 601A and 601B when switched to a second (middle) position connect to lines 603C and 603D, respectively. In this configuration, horn antenna sets 602C and 602D, which are connected to lines 603C and 603D, are used. Switches 601A and 601B when switched to a third (bottom) position connect to lines 603E and 603F, respectively. In this configuration, horn antenna sets 602E and 602F, which are connected to lines 603E and 603F, are used.

This antenna selection configuration can advantageously provide substantially an omni-directional pattern with antenna pairs. In one embodiment, search algorithms can be used to select the optimum antenna pairs. For example, in light of multipath conditions, different antenna pairs can be used to improve link quality and throughput. Advantageously, the resulting configuration can provide directional beams for vertical polarization. In another embodiment, extra states of switches 601A and 601B (i.e. using a first position of one switch and a second position of the other switch) can be used for polarization diversity.

In one embodiment, switches 601A and 601B can be implemented using standard SP3T (single-pole three-throw) switches. In other embodiments using more horn antenna sets, other standard switches can be used. For example, in the case of eight horn antenna sets, SP4T (single-pole four-throw) switches or PiN diodes can be used to configure the circular antenna array.

In one embodiment, referring also to FIG. 1, switches 601A and 601B can be mounted in an area outside the circumference delineated by circular antenna array 100. In this case, lines 603A-603F would preferably connect to feeder elements 103 using traces in a lower layer of substrate 102 (i.e. lower than the top layer shown in FIG. 2) and pads 204. In another embodiment, switches 601A and 601B can be mounted in area 104. In this case, lines 603A-603F can be implemented using metal wires or using traces in a layer of substrate 102. Notably, area 104 is preferably kept free of components to improve the performance of circular antenna array 100. In some embodiments where the area outside the circumference delineated by circular antenna array 100 is limited and/or where antenna performance is less rigorously required, area 104 can be used only for switches 601A and 601B and lines 603A-603F.

In another high gain antenna embodiment, the horns of a circular antenna array can be replaced with Yagi antennas. Yagi antennas are known to those skilled in the art of high frequency wireless communications. Exemplary Yagi antennas are described in U.S. Pat. No. 6,326,922, which issued Dec. 4, 2001 to Hegendoefer, and U.S. Pat. No. 6,307,524, which issued Oct. 23, 2001 to Britain.

Figure 7A:
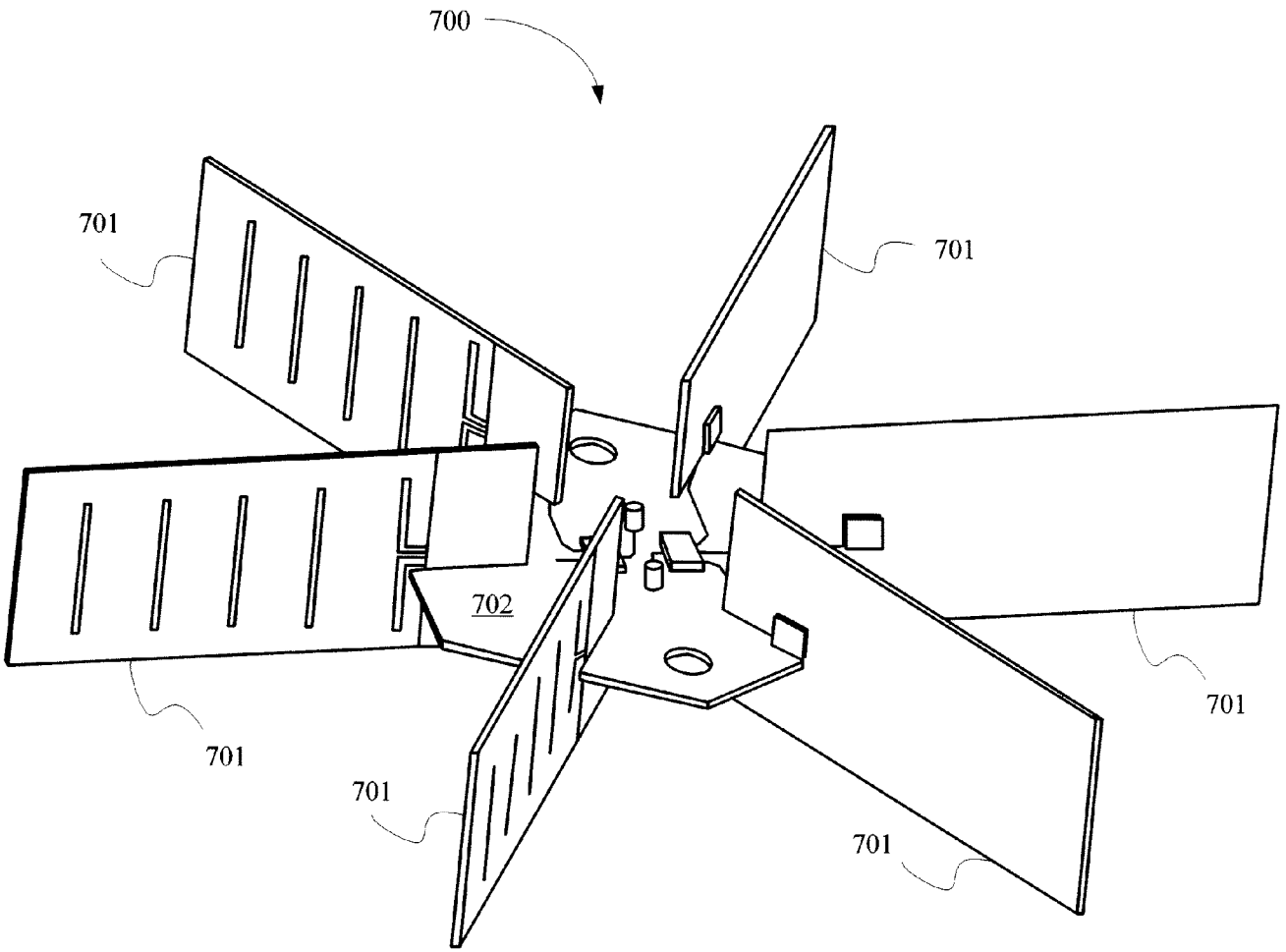
FIG. 7A illustrates a perspective view of an exemplary circular antenna array including Yagi antennas.
Figure 7B:
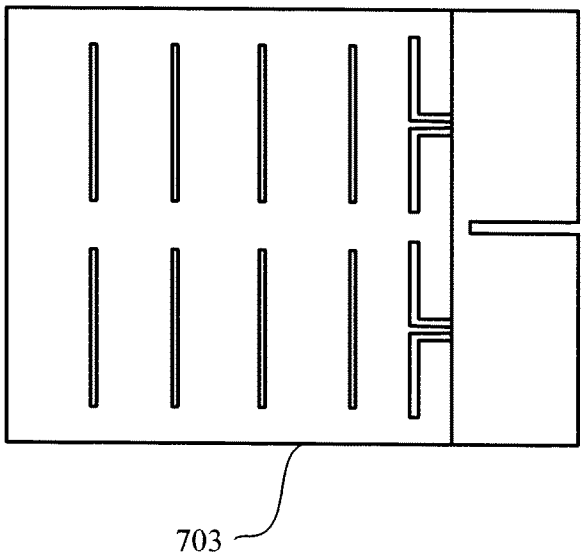
FIG. 7B illustrates an exemplary "stacked" Yagi antenna for the circular antenna array shown in FIG. 7A.

FIG. 7A illustrates an exemplary circular antenna array 700 including six Yagi antennas 701 fitted in slots provided in a switch board 702. FIG. 7B illustrates an exemplary Yagi antenna 703 in which a plurality of Yagi antennas are "stacked". This exemplary illustration shows two Yagi antennas, but other embodiments may have more. In one embodiment, Yagi antenna 703 may be used in place of Yagi antenna 701 in antenna array 700.

Figure 8:
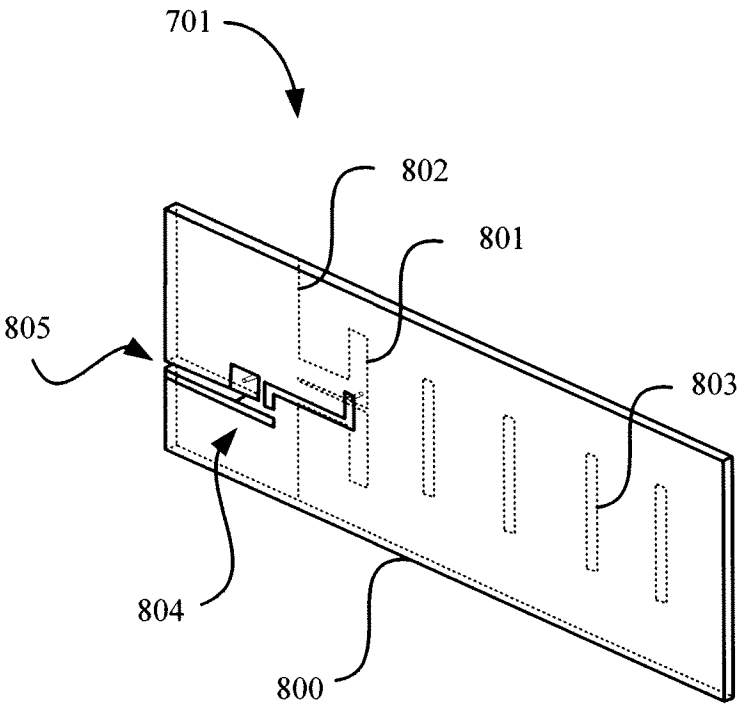
FIG. 8 illustrates an exemplary printed Yagi antenna for the circular antenna array shown in FIG. 7A.

FIG. 8 illustrates another exemplary Yagi antenna 701. In one embodiment, Yagi antenna 701 can be printed on a substrate 800, e.g. a printed circuit board (PCB). In the embodiment shown in FIG. 8, the back side of substrate 800 can include a dipole antenna 801, a reflector 802, and four passive director elements 803. Note that although four passive director elements 803 are shown in FIG. 8, more or less director elements can be used to adjust the antenna gain. In this embodiment, the front of substrate 800 can include a printed antenna feed line 804 to implement a balun (which can provide a stable, independent pattern). A slot 805 can be used for mating Yagi antenna 701 to switch board 702.

Figure 9:
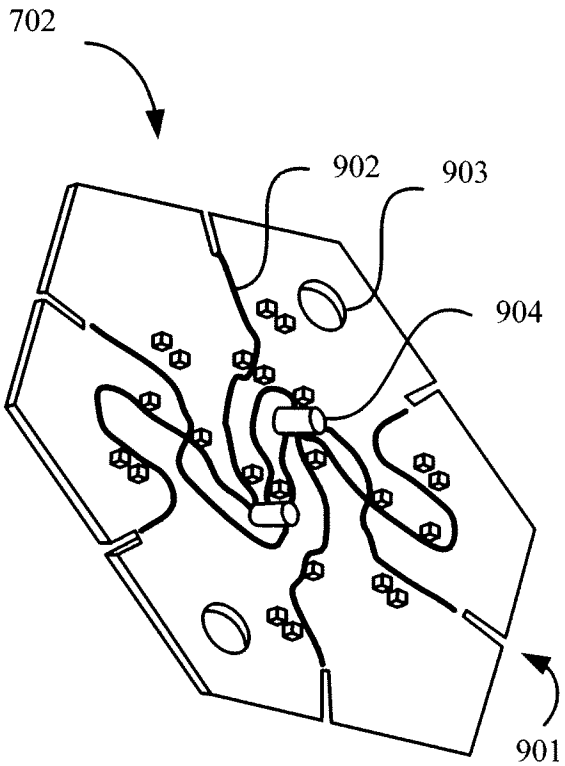
FIG. 9 illustrates an exemplary switch board for mounting the circular antenna array shown in FIG. 7A.

FIG. 9 illustrates an exemplary switch board 702 including a plurality of slots 901. Slots 901 can be used for mating with Yagi antennas 701 to form circular antenna array 700. In one embodiment, switch board 702 can be used for a 2×2 MIMO solution having two RF inputs 904. Therefore, in this case, each RF input 904 can be connected to three Yagi antennas 701 via traces 902 and switches located within switch board 702. Note that other embodiments of a circular antenna array can use sets of 2 or more Yagi antennas. In one embodiment, switch board 702 can be implemented with a two-layer PCB and crossed RF traces 903. In other embodiments, switch board 702 can be implemented with a PCB having more than two layers to avoid crossing RF traces.

Figure 10:
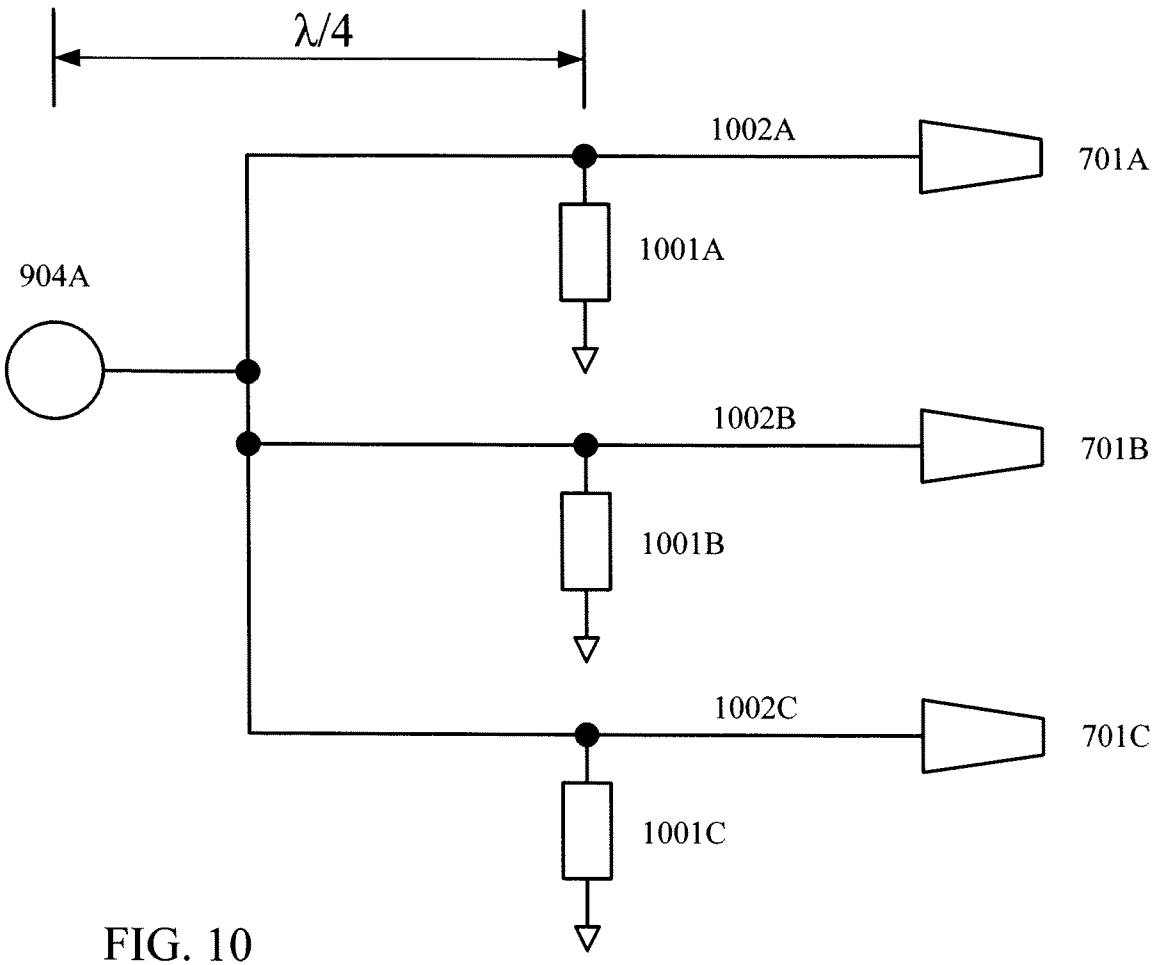
FIG. 10 illustrates an exemplary switching configuration for half of the switch board shown in FIG. 9.

FIG. 10 illustrates an exemplary switching configuration for half of switch board 702, i.e. three Yagi antennas. In this embodiment, antenna switching can accomplished by providing a plurality of shunt PiN diode switches, wherein a shunt PiN diode switch 1001A is connected on a line/trace 1002A connected between an RF input feed 904A and a Yagi antenna 701A. Similarly, a shunt PiN diode switch 1001B is connected on a line/trace 1002B connected between RF input feed 904A and a Yagi antenna 701B, and a shunt PiN diode switch 1001C is connected on a line/trace 1002C connected between RF input feed 904A and a Yagi antenna 701C. Note that a PiN diode is a diode with a wide, lightly doped 'near' intrinsic semiconductor region between a p-type semiconductor region and an n-type semiconductor region. In one embodiment, a radial stub is placed in series with the PiN diode to generate a good RF short at high frequency. Note that in other embodiments of a circular antenna array including Yagis, other types of RF switches can be used.

Notably, each of shunt PiN diode switches 1001A-1001C can be located at a quarter wavelength ($\lambda/4$) from the common feed point, i.e. RF input feed 904A. Turning "on" a PiN diode shorts the transmission line and results in an "open" circuit impedance at the RF input feed. To connect RF input feed 904 to a particular Yagi antenna, that PiN diode is left "off". Advantageously, the configuration shown in FIG. 10 can allow more than one Yagi antenna with degraded VSWR (voltage standing wave ratio) to be used. Also advantageously, energizing more than one Yagi antenna can enable generating multiple forms of radiation patterns, including a quasi-omni-directional pattern.

Nominally, the beam width of each antenna 701A-701C is in the range of 60-70 degrees for both Azimuth and elevation planes. These beam widths can provide partial overlapping of the wireless communication streams. In one embodiment, the nominal antenna gain can be about 7 dbi. Note that printing longer director elements 803 on Yagi antennas 701 can further increase the gain of array 700.

Figure 11:
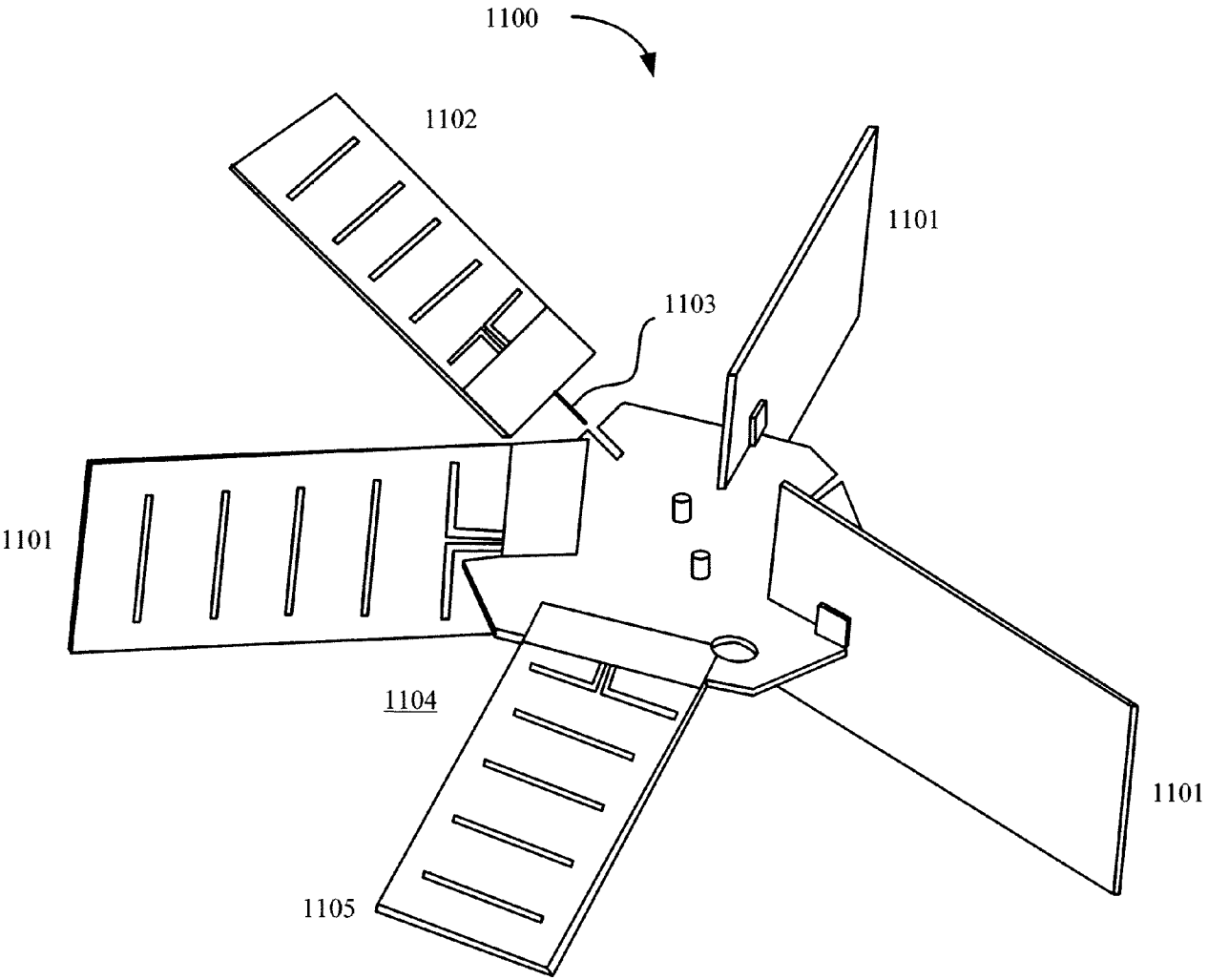
FIG. 11 illustrates a circular antenna array including both vertically-oriented and horizontally-oriented Yagi antennas.

In one embodiment shown in FIG. 11, a circular antenna array 1100 can include a first set of Yagi antennas 1101 oriented vertically relative to switch board 1104 and a second set of Yagi antennas 1102 oriented horizontally (one shown mated with switch board 1104 and the other about to be mated), thereby allowing better polarization diversity. In this embodiment, Yagi antennas 1102 can include an adapter 1103, thereby allowing each Yagi antenna 1101 to be coupled to switch board 1104 in an orientation that may be about 90 degrees offset with respect to a neighboring Yagi antenna 1101. Another technique to orient a Yagi antenna is to integrally form one or more Yagi antennas with switch board 1104, as shown by Yagi antenna 1105.

Figure 12:
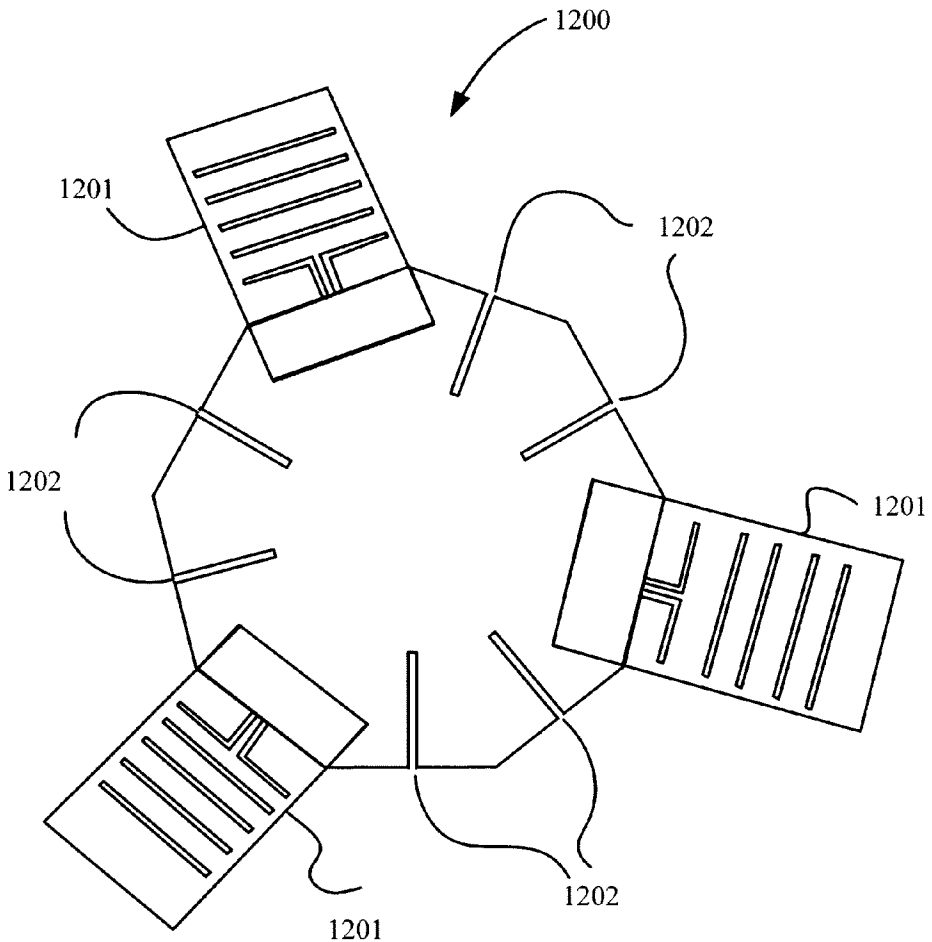
FIG. 12 illustrates an exemplary switch board for use with a 3×3 MIMO system.

Note that for a 3×3 MIMO system, a circular antenna array including nine Yagi antennas can be used. In one embodiment, these nine Yagi antennas can be oriented vertically. In another embodiment, three of the nine Yagi antennas (e.g. every third antenna) can be oriented horizontally with respect to the switch board. In yet another embodiment, the horizontally-oriented Yagi antennas can be fabricated as part of the (i.e. integrally with the) switch board. FIG. 12 illustrates an exemplary switch board 1200 for use with a 3×3 MIMO system. As shown, switch board 1200 includes three integrated horizontal Yagi antennas 1201 and six slots 1202 for coupling vertical Yagi antennas, such as Yagi antenna 701 or Yagi antenna 703.

Although illustrative embodiments of the invention have been described in detail herein with reference to the accompanying figures, the embodiments described herein are not intended to be exhaustive or to limit the invention to the precise forms disclosed. As such, many modifications and variations will be apparent. Accordingly, it is intended that the scope of the invention be defined by the following Claims and their equivalents.

The invention claimed is:

1. A circular antenna array comprising:

a substrate including a plurality of metal traces and a plurality of slots;

a plurality of horn antennas secured to the substrate using the metal traces, each horn antenna including a plurality of tabs that fit into a subset of the plurality of slots, each horn antenna formed from a material sheet bent to form sides of the horn antenna, the substrate forming a side to each horn antenna, the plurality of horn antennas positioned radially from a predetermined area on the substrate, the predetermined area being free of components; and a plurality of feed elements, each feed element being positioned inside an associated horn antenna and secured to the substrate.

2. The circular antenna array of claim 1, wherein the substrate is a printed circuit board (PCB).

3. The circular antenna array of claim 1, wherein each horn antenna is formed from sheet metal.

4. The circular antenna array of claim 1, wherein each feed element includes an inverted-F component with support legs.

5. The circular antenna array of claim 1, further including a plurality of switching elements, wherein each switch position of each switching element connects to a set of the plurality of horn antennas.

6. The circular antenna array of claim 1, further including two switches, wherein each switch position of each switch connects to a set of the plurality of horn antennas.

7. A circular antenna array comprising:

a substrate including a plurality of metal traces and a plurality of slots;

a plurality of horn antennas secured to the substrate using the plurality of metal traces, each horn antenna including a plurality of tabs that fit into a subset of the plurality of slots, each horn antenna formed from a material sheet bent to form sides of the horn antenna, the substrate forming a side to each horn antenna, the plurality of horn antennas positioned radially from a predetermined area on the substrate, the predetermined area being free of components except for switching elements associated with the plurality of horn antennas; and a plurality of feed elements, each feed element being positioned inside an associated horn antenna and secured to the substrate.

8. The circular antenna array of claim 7, wherein the substrate is a printed circuit board (PCB).

9. The circular antenna array of claim 7, wherein each horn antenna is formed from sheet metal.

10. The circular antenna array claim 7, wherein each feed element includes an inverted-F component with support legs.

11. The circular antenna array of claim 7, further including a plurality of switching elements, wherein each switch position of each switching element connects to a set of the plurality of horn antennas.

12. The circular antenna array of claim 7, further including two switches, wherein each switch position of each switch connects to a set of the plurality of horn antennas.

13. A method for operating a circular antenna array including a substrate having a plurality of metal traces and a plurality of slots, the method comprising:

configuring the circular antenna array with a plurality of horn antennas secured to the substrate using the metal traces, each horn antenna including a plurality of tabs that fit into a subset of the plurality of slots, each horn antenna formed from a material sheet bent to form sides of the horn antenna, the plurality of horn antennas positioned radially from a predetermined area on the substrate, the substrate forming a side to each horn antenna;

selecting a horn antenna set from the plurality of horn antennas using a plurality of switches; and receiving or transmitting a multiple-input multiple-output (MIMO) stream using the horn antenna set.

14. The method of claim 13, further comprising:

switching two MIMO streams between a first horn antenna set and a second horn antenna set.

15. The method of claim 13, further comprising:

searching for another horn antenna set based on link quality or throughput.

16. The method of claim 13, wherein the horn antenna set includes a pair of adjacent horn antennas.

17. The method of claim 13, wherein each selected horn antenna set includes a pair of adjacent horn antennas to provide an omni-directional pattern.

18. The method of claim 13, further including providing a predetermined directional pattern using the plurality of switches to select a predetermined horn antenna set.

* * * * *